United States Patent [19]

Shapenko et al.

[11] Patent Number: 4,909,812

[45] Date of Patent: Mar. 20, 1990

[54] DEVICE FOR POWER SUPPLY OF GAS-CLEANING ELECTRICAL PRECIPITATORS

[75] Inventors: Valentina N. Shapenko; Vladimir I. Perevodchikov; Vladimir N. Lisin; Iosif G. Khomsky, all of Moscow; Valery M. Stuchenkov, Moskovskaya; Alexandr A. Savin, Moscow; Vladimir E. Mareev, Moscow; Jury G. Petrov, Moscow; Igor V. Ermilov, Moskovskaya; Garri Z. Mirzabekyan, Moscow, all of U.S.S.R.

[73] Assignee: Vsesojuzny elektrotekhnichesky institute imeni V.I. Lenina, Moscow, U.S.S.R.

[21] Appl. No.: 337,529

[22] PCT Filed: May 26, 1987

[86] PCT No.: PCT/SU87/00062

§ 371 Date: Jan. 11, 1989

§ 102(e) Date: Jan. 11, 1989

[87] PCT Pub. No.: WO88/09214

PCT Pub. Date: Dec. 1, 1988

[30] Foreign Application Priority Data

Dec. 17, 1984 [SU] U.S.S.R. ..... 3824811
Dec. 17, 1984 [SU] U.S.S.R. ..... 3824862

[51] Int. Cl.[4] ..... B03C 3/02

[52] U.S. Cl. ..... 55/139; 323/903; 55/105

[58] Field of Search ..... 55/105, 139; 323/903

[56] References Cited

U.S. PATENT DOCUMENTS

| | | | |
|---|---|---|---|
| 3,641,740 | 2/1972 | Schumann | 55/105 |
| 4,183,736 | 1/1980 | Milde | 55/139 |
| 4,536,698 | 8/1985 | Shevalenko | 323/903 |
| 4,567,541 | 1/1986 | Teral | 55/139 |

FOREIGN PATENT DOCUMENTS

| | | | |
|---|---|---|---|
| 217120 | 1/1957 | Australia | 55/105 |

*Primary Examiner*—Bernard Nozick
*Attorney, Agent, or Firm*—Burgess, Ryan & Wayne

[57] ABSTRACT

A device for power supply of gas-cleaning electrical precipitators comprises two constant voltage sources (1,2), the unlike poles (5,6) of each of the sources being grounded. Two high-voltage commutators made as triode-type thermionic rectifiers (7,8) with a hollow anode (11) are connected between the other unlike poles of each of the constant voltage sources (1,2) and a corona displaying electrode (16) of an electrical precipitator (17). Connected to a cathode (9) and a control electrode (10) of each of the triode-type thermionic rectifiers (7,8) are modulators (18, 19) of alternating polarity voltage which are connected through isolation transformers (38,39) to a control unit (40), the latter being connected to pickups (49,50,51,52) of electrical and physical parameters. Each electric circuit is provided with series-connected inductive storage elements (13,15), the electric circuit comprising series-connected the constant voltage source (1,2), the triode-type thermionic rectifier (7,8) and the corona-displaying electrode (16) of the electrical precipitator (17).

4 Claims, 6 Drawing Sheets

DEVICE FOR POWER SUPPLY OF GAS-CLEANING ELECTRICAL PRECIPITATORS

TECHNICAL FIELD

The invention relates to energy converters and more specifically, to devices for power supply of electrical precipitators used in gas cleaning.

PRIOR ART

The most widespread use has been found up until now by the unipolar power supply installations for electrical precipitators which suffer from lower efficiency of dust catching and gas cleaning and an increased volume resistance of the precipitated dust layer, exceeding $10^9$ Ohm cm. Thus, the precipitated dust layer has not enough time to discharge, so that its charging process proceeds until the dust layer gets broken down, and a back corona discharge occurs. As a result, the breakdown voltage of the interelectrode gap in the electrical precipitator is reduced and gas cleaning efficiency is affected. In addition, unipolar power supply installations built around single-phase transformer-rectifier circuits feature but low installed power utilization factor.

Moreover, spark- and arc-discharges are liable to arise in the course of the electrical precipitator operation, which affect adversely the operational reliability of the gas-cleaning electrical precipitator as a whole. To restrict the resultant transient short-circuit currents, use is made of current-limiting reactors or magnetic amplifiers featuring high reactance, whose power makes up to one-third the useful power of the power supply installation itself, whereas their useful function is utilized only at short intervals when spark-or arc discharges occur. Application of high reactance by inserting into the power circuit current-limiting reactors or magnetic amplifiers leads to overrated installed power of the device and to the doubled output voltage during idle run of the device.

Extensively known in the art is a device for power supply of gas-cleaning electrical precipitators, featuring unipolar power supply and comprising a mains-fed current-limiting reactor and series-connected a thyristor controller, a high-voltage single-phase transformer, and a bridge rectifier one of whose poles is grounded, and the other is connected, via a limiting reactor, to the corona-displaying electrode of the electrical precipitator (cf. G. M. A. Aliev, Power packs of electrical precipitators, 1981 Energoizdat Publishers (Moscow), p.55, FIG. 29 (in Russian). The electric precipitator is provided with a power-operated system of shaking the precipitating electrodes, which is put in operation at certain time intervals by the actuating mechanism.

Efficiency of gas cleaning in the electrical precipitator in terms of the rate of precipitation of charged dust particles on the precipitating electrode, depends on the shape of pulses of working voltage applied to the electric precipitator. In its turn, the working voltage depends on the rectification method, principle of regulation of this voltage, level of the output parameters of the device, and its external-volt-ampere characteristics. A highly pulsating voltage, though capable of quenching arc discharges occurring across the interelectrode gap of the electrical precipitator, affects badly the efficiency and other power characteristics of the device, such as installed power utilization factor.

When cleaning gases containing high-resistance dust particles, an increase in the voltage and current results in a higher degree of gas cleaning until a certain critical value of the output parameters is attained, at which the back corona discharge process occurs. As a result, the effectiveness of the power supply device is impaired.

In the device under consideration the voltage of the electrical precipitator is adjusted against the average number of spark breakdowns through the precipitator interelectrode gap. This results in an unstable operation of the device, excess power consumption and adversely affected effectivity of the gas cleaning technological process, since an optimum number of the interelectrode gap spark breakdowns is determined by the parameters of the gas flow being cleaned, i.e., moisture content, chemical composition, and dust particle size distribution.

The voltage on the electrical precipitator is maintained at the maximum level, whereby the spark breakdowns through the interelectrode gap of the electrical precipitator become regular. As a result, there is established electromagnetic incompatibility of the power supply conditions of the device and electrophysical processes proceeding in the load, which leads to unstable operation of the device and failure of some individual components thereof, most frequently, the thyristor controller and high-voltage electric cable running from the rectifier pole and the corona-displaying electrode.

One more device for power supply of a gas-cleaning electrical precipitator capable of providing unipolar power supply, is known to comprise a main source of high constant voltage, composed of a series-connected transformer and a rectifier (U.S. Pat. No. 4,183,736). The output of the main source of high constant voltage is connected to an additional source of pulsed voltage whose output is connected to the corona-displaying electrode of the electrical precipitator. The value of the pulsed voltage of the additional source equals approximately 10 percent of the main source voltage.

With the device operating, the pulsed voltage of the additional source is superimposed on the constant voltage of the main source and is adjusted for amplitude, frequency and pulse width. This makes it possible to effect flexible control over the density of the corona discharge current and reduce the intensity of the back corona discharge in the electric precipitator. The device under discussion is featured by a low installed power utilization factor and unstable operation as for cleaning of gases containing high-resistance dust particles. The device in question fails to provide compatibility of the electromagnetic processes running in the power source with the electrophysical processes proceeding in the load and hence to afford an effective protection of the device against spark discharges and arc breakdowns through the interelectrode gap of the electrical precipitator. Power supply of a multisection electrical precipitator from a single common power source, which is most favourable from the viewpoint of energy consumption, is hindered due to impossibility of separate adjustment of electrical parameters of each electrical precipitator section (i.e., corona discharge current).

Still one more device for power supply of a gas-cleaning electrical precipitator is known to comprise a direct-current source whose output is connected, through a number of parallel-connected diodes, to a number of parallel-connected capacitors, which periodically discharge, through thyristors, into the parallel-connected primaries of a step-up transformer, whose secondary is connected to the corona-displaying electrode of the electric precipitator (U.S. Pat. No. 3,641,740). Use of pulsed voltage of a microsecond range for power supply of the electric precipitator makes it possible to increase the maximum operating voltage effective between the corona-displaying electrode and the precipitating electrode of the electrical precipitator and to intensify the charging process of the dust particles. However, effectiveness of the principal technological process of gas cleaning, which depends on the rate of precipitation and neutralization of the dust particles, fails to increase due to the fact that rapid discharge of the capacitors results in too frequent recharging of the dust particles.

The installed power utilization factor and efficiency of the power supply device under discussion is as low as 0.5.

Widely known in the present state of the art is also a device for power supply of gas-cleaning electric precipitators, which provide alternating-polarity power supply and comprises two adjustable sources of high constant voltage, the opposite poles of each of said sources being grounded (SU, A, 904,786). Two high-voltage commutators are cut in-between the other opposite poles of each of the power sources and the corona-displaying electrode of the electrical precipitator. The device comprises also a control unit whose inputs are connected to the pickups of electrical and physical parameters, while its outputs are connected to the high-voltage commutators.

The high-voltage commutators which are in fact electromechanical switches, in response to a signal from the control unit, periodically disconnect the corona-displaying electrodes of the electrical precipitator from one of the sources of constant voltage and connect them to the other source, thus shaping an alternating-polarity voltage on the electrodes of the electrical precipitator and ensuring cyclic recharging of the precipitator own capacity.

Application of a square-pulse alternating-polarity voltage featuring large-width pulses ($\tau \sim 1$s) provides for optimum recharging conditions for the dust particles in the electrical precipitator and eliminates the causes of the back corona discharge in the dust layer precipitated on the precipitating electrode. However, at the instant of reversal of the voltage polarity the electrical precipitator remains charged to a high voltage of the preceding polarity. As a result, an uncontrolled electric discharge is liable to occur in the high-voltage commutators, and operational reliability of the power equipment of the device is affected adversely. To eliminate an electric charge from the commutation gaps, the known device is provided with an additional controlled discharge element cut in parallel with the corona-displaying electrode and connected to the control unit. Cyclic operation of the controlled discharge element is accompanied by transient processes occurring in the power circuit and the control unit, which impairs the effectiveness of the gas cleaning process and operational reliability of the device. Operation of the device is also sophisticated due to a necessity for periodic ground-connection of the corona-displaying electrode. Current limiting in the case of spark and arc discharges arising in the electrical precipitator is attained due to inserting high reactance into the circuit, which adversely affects the efficiency and the installed power utilization factor of the device. In cases of no-load operation overvoltage in the power supply circuit is inescapable, which overvoltage might be dangerous to the insulation of the device.

Insertion of high reactance into the construction of the device to afford protection against arc breakdowns in the load results not only in an increased installed power but also imposes limitation on the range of effective cleaning conditions when handling gases containing high-resistance dust particles, and on the power supply of multisection electrical precipitators. Since the volt-ampere characteristic of the electrical precipitator depends on the dust concentration, multisection precipitators feature dependence of the current and voltage of a next section upon the electric parameters of the preceding section. Efficient operation of the electrical precipitator is possible only when each section is supplied from its own individual source of voltage, which restricts the functional capabilities and energy parameters of the power supply device considered herein.

OBJECTION AND SUMMARY OF THE INVENTION

The present invention has for its primary object to provide a device for power supply of gas-cleaning electrical precipitators provided with high-voltage commutators whose circuitry makes it possible to limit voltages and currents during transient processes occurring in the device, and to provide higher reliability of the device and better quality of gas cleaning.

The object mentioned above is accomplished due to the fact that in a device for power supply of gas-cleaning electrical precipitators comprising two sources of constant voltage, the unlike poles of each of said sources being grounded, two high-voltage commutators connected between the other unlike poles of each of the constant voltage sources and the corona-displaying electrode of the electrical precipitator, and a control unit connected through its inputs to pickups of electrical and physical parameters, and through its outputs, to the high-voltage commutators according to the invention, the high-voltage commutators are in fact triode-type thermionic rectifiers with a hollow anode and the device also comprises modulators of alternating-polarity voltage equal in number to the number of the thermionic rectifiers, each of said rectifiers having its input connected through its isolation transformer to the control unit and first and second outputs connected to the cathode and the control electrode of the thermionic rectifier, the device further comprising inductive storage elements each of which is connected to an electric circuit consisting of series-connected the source of constant voltage, the thermionic rectifier, and the corona-displaying electrode of the electrical precipitator.

It is expedient that with a view to increasing the efficiency of regeneration of the energy of fast transient processes running in the device, the anode of the thermionic rectifiers be shaped as a Faraday cup.

It is also expedient that with a view to further increasing the operational reliability of the device, the alternating-polarity voltage modulators be arranged in a conducting screen whose external surface is conductively coupled with the control electrode of the thermionic rectifier, while the first output of the alternating-polarity voltage modulator is insulated from the screen, and the second output is connected to the internal surface of the conducting screen.

It is also expedient that with a view of enhancing the efficiency of the device and the installed power utilization factor when supplying power to multisection electrical precipitators, each pair of the thermionic rectifiers, which is equal in number to the number of sections in the precipitator, be connected in parallel between the unlike poles of two sources of constant voltage, and the inductive storage elements be in fact pulse transformers whose primaries are connected to at least two additional modulators connected to the control unit, while the secondaries of the pulse transformers are series-connected between the thermionic rectifier and the corona-displaying electrode of the electrical precipitator.

Practical implementation of the present invention makes it possible to effectively limit voltages and currents during transient processes occurring in the device in response to the reversal of the power supply polarity of an electrical gas-cleaning precipitator, to enhance the operational reliability of the device and better the quality of gas cleaning.

BRIEF DESCRIPTION OF THE DRAWINGS

In what follows the invention is illustrated by a detailed description of some specific embodiments of a device for power supply of gas-cleaning electrical precipitators to be read with reference to the accompanying drawings, wherein.

PREFERRED EMBODIMENT OF THE INVENTION

Figure 1:
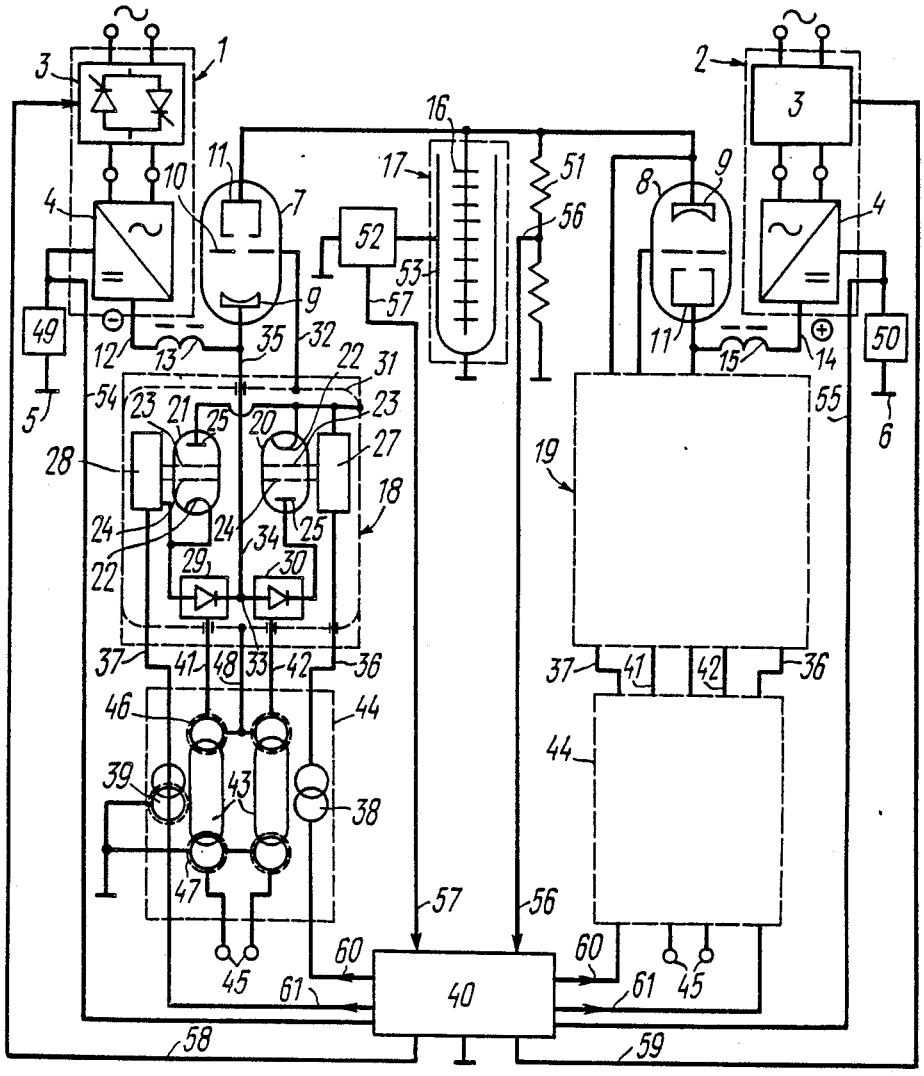
FIG. 1 is a block-diagram of a device for power supply of single-section gas-cleaning electrical precipitators, according to the invention.

The device for power supply of a gas-cleaning electrical precipitator comprises two adjustable sources 1, 2 (FIG. 1) of high constant voltage, each incorporating a series-connected contactor 3 connected to power mains, and a rectifying transformer 4. A positive pole 5 of the source 1 and a negative pole 6 of the source 2 of constant voltage are grounded.

The contactor 3 of the high constant voltage sources 1, 2 is a commonly known construction (cf. S. V. Shapiro, A. S. Serebriakov, V. I. Panteleyev, Thyristor and magnetothyristor power supply united for gas-cleaning electrical precipitators, 1978, Energia Publishers, Moscow, p.31, FIGS. 2, 3 (in Russian).

The devices comprised also two high-voltage commutators in the form of thermionic rectifiers 7, 8 of the triode type, having a cathode 9, a control electrode 10, and a hollow anode 11.

The hollow anode 11 of the thermionic rectifiers 7, 8 can be in fact a Faraday cup.

The thermionic rectifier 7 is connected, through its cathode 9, to a negative pole 12 of the constant voltage source 1 via an inductive storage element 13. The thermionic rectifier 8 is connected, by means of its anode 11, to a positive pole 14 of the constant voltage source 2 via an inductive storage element 15. The anode 11 of the thermionic rectifier 7 and the cathode 9 of the thermionic rectifier 8 are connected to a corona-displaying electrode 16 of a gas-cleaning electrical precipitator 17.

The thermionic rectifiers 7, 8 are connected to alternating-polarity voltage modulators 18, 19, which comprise respective thermionic tubes 20, 21 connected in phase opposition and having respectively a cathode 22, control electrodes 23, 24, and an anode 25. The cathode 22 of the tube 20 and the anode 25 of the tube 21 are connected to the circuit of the control electrode 10 of the thermionic rectifiers 7, 8 to form an output 26 of the modulators 18, 19. The control electrodes 23, 24 of the thermionic tubes 20, 21 are connected to respective pulse shapers 27, 28. The cathode 22 of the thermionic tube 21 and the anode 25 of the thermionic tube 20 are connected to respective modulating rectifiers 29, 30 connected in parallel with each other. The modulating rectifier 29 is coupled to the pulse shaper 28.

The modulating rectifier 30 is connected to the pulse shaper 27.

Each of the alternating-polarity voltage modulators 18, 19 is arranged in a conducting screen 31.

The cathode 22 of the thermionic tube 20 and the anode 25 of the thermionic tube 21 are connected to each other and to the conducting screen 31 whose external surface is conductively coupled, through a contact 32, to the control electrode 10. A point 33 of connection of the poles of the modulating rectifiers 29, 30 is connected to a conductor 34, which establishes an insulated output 35 of the modulators 18, 19 of alternating-polarity voltage, said output 35 being connected to the cathode 9 of the thermionic rectifiers 7, 8.

The inputs of the pulse shapers 27, 28, which form control inputs 36, 37 of the alternating-polarity voltage modulators 18, 19 are connected, through signalling isolation transformers 38, 39, with the outputs of a control unit 40. The inputs of the modulating rectifiers 29, 30 establishing inputs 41, 42 of the alternating-polarity voltage modulators 18, 19, are connected to a power mains 45 through power isolation transformers 43 enclosed in a screening casing 44.

The signalling isolation transformers 38, 39 and the power isolation transformers 43 are enclosed in the screening casing 44, whereon the screen 31 and the rectifier 7 are situated.

The windings of the isolation transformers 38, 39 have high-potential electrostatic screens 46 and grounded screens 47 interconnected through a leadout 48 to the conducting screen 31 of the alternating-polarity voltage modulators 18, 19.

The device comprises also current pickups 49, 50 of the constant-voltage sources, connected to the grounded poles 5, 6 of the constant voltage sources 1, 2; a resistor 51 of voltage effective on the corona-displaying electrode of the electrical precipitator, connected to the corona-displaying electrode 16 of the electrical precipitator 17; a back corona discharge pickup 52 connected to a precipitating electrode 53 of the electrical precipitator 17. Outputs 54, 55 of the current pickups 49, 50 of the constant-voltage sources, an output 56 of the voltage on the corona-displaying electrode of the electrical precipitator, and an output 57 of the back corona discharge pickup 52 are connected to the inputs of the control unit 40.

The control unit 40 is connected, through its outputs 58, 59, to the contactors 3 of the constant voltage sources 1, 2, and through its leadouts 60, 61, to the signalling isolation transformers 38, 39.

The circuitry of the control unit 40 is a matter of common knowledge (cf. Electrical-engineering industry, Series 'High-voltage devices, transformers, power capacitors', Issue 9/122, 1981 (Moscow; V. I. Perevodchikov et al., Electronic commutators for power supply sources of electrical precipitators, pp. 16–18, in Russian).

In a power supply device for multisection gas-cleaning electrical precipitators, wherein, e.g., the electrical precipitator 17 is composed of three sections 62, 63, 64 (FIG. 2), each pair of the thermionic rectifiers 7, 8 equal in number to the number of the sections 62, 63, 64 of the electrical precipitators 17, is connected in parallel between the unlike poles 12, 14 of the constant voltage sources 1, 2. The inductive storage elements are made as pulse transformers 65, 66. A primary 67 of each pulse transformer 65, 66 is connected with its output 68 to an additional modulator 69. A secondary 70 of each pulse transformer 65, 66 is series-connected between the thermionic rectifier 7 or 8 and the corona-displaying electrode 16 of each of the sections 62, 63, 64 of the multisection electrical precipitator. Outputs 71, 72 of the additional modulators 69 are connected to the control unit 40. The thermionic rectifiers 7, 8 connected between the two constant voltage sources 1, 2, establish together with the secondaries 70 of the pulse transformers 65, 66 arms 73, 74, 75, 76, 77, 78 of a multiple-arm commutation bridge, the corona-displaying electrode 16 of each of the sections 62, 63, 64 of the electrical precipitator 17 being cut in a galvanically split diagonal of said commutation bridge.

In a given embodiment of the device for power supply of an electrical precipitator the constant voltage sources 1, 2 comprise the contactor 3 and the rectifying transformer 4 which is in fact a step-up transformer 79 whose secondary is connected to a bridge rectifier 80.

The additional amplifier 69 comprises series-connected a thyristor controller 81 (FIG. 3) connected to a power mains 82, a charging source 83, a charging reactor 84, a diode 85 and a commutating thyristor 86 connected in parallel with a shaping line 87. The pulse transformer 65 or 66 is connected, through its output 68, to the circuit of the shaping line 87. The commutating thyristor 86 is connected between a grounded leadout 88 of the primary 67 of each pulse transformer 65, 66 and an input 89 of the shaping line 87. The outputs of the thyristor controller 81 and of the commutating thyristor 86 establish the outputs 71, 72 of the additional modulator 69 which are connected to the control unit 40.

Figure 4:
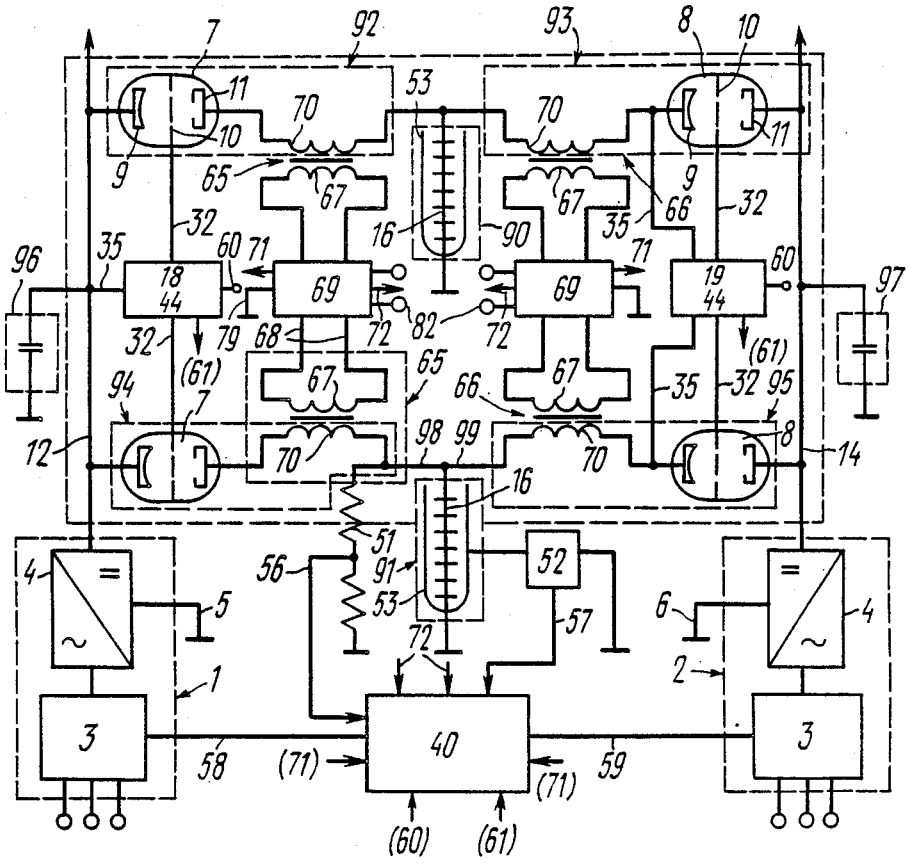
FIG. 4 is a block-diagram of another embodiment of a device for power supply of multisection electrical precipitators for gas cleaning, according to the invention.

One more embodiment of the device for power supply of a multisection electrical precipitator as illustrated in FIG. 4 is also practicable. The gas-cleaning electrical precipitator 17 has two sections 90 and 91. Arms 92, 93, 94, 95 of a four-arm commutation bridge are formed by the series-connected thermionic rectifiers 7, 8 and the secondaries 70 of the pulse transformers 65, 66, whose primaries 67 are connected to the two additional modulators 69. Damping RC-circuits 96, 97 are connected to the unlike poles 12, 14 of the high-voltage sources 1, 2.

Use of damping LC-circuits is also practicable.

The commutation bridge diagonals are connected to the corona-displaying electrodes 16 of each section 90, 91 of the electrical precipitator 17 through high-voltage electric cables 98, 99.

The device for power supply of a gas-cleaning electrical precipitator operates as follows.

When in the initial state the thermionic tubes 21 (FIG. 1) of the alternating-polarity voltage modulators 18, 19 are conducting, negative cutoff voltage is applied to the control electrodes 10 of the thermionic rectifiers 7, 8, said voltage arriving from the rectifiers 29 of the modulators 18, 19. The device is smoothly brought to the no-load running by means of the contactor 3 of the constant voltage sources 1, 2. Once a preset output voltage level of the constant voltage sources 1, 2 has been attained a signal sent by the pickup 51 of voltage on the corona-displaying electrode of the electrical precipitator arrives at the input of the control unit 40, said signal being adapted to shape signals delivered from the leadouts 60, 61 of the control unit 40 through the isolation transformers 38, 39 to the inputs 36, 37 of the alternating-polarity voltage modulators 18, 19. It is due to said signals sent by the control unit 40 that the thermionic rectifiers 7, 8 are enabled and disabled alternately by changing the electrostatic potential of the external surface of the conducting screen 31, said potential being controlled by the alternating-polarity voltage modulators 18, 19 and impressed upon the control electrode 10 of the thermionic rectifier 7 or 8.

The disabled state of one of the thermionic rectifiers 7, 8 takes place with the negative potential on the control electrode 10. A corresponding negative-polarity voltage is shaped by the modulating rectifier 29 and by the thermionic tube 21 of the alternating-polarity voltage modulators 18, 19.

The enabled state of one of the thermionic rectifiers 7, 8 take place with the positive potential on the control electrode 10. A corresponding positive-polarity voltage is shaped by the rectifier 30, the thermionic tube 20 and the pulse shaper 27 of the alternating-polarity voltage modulators 18, 19.

Depending on the current level of the electrical precipitator 17, voltage on the control electrode 10 of the thermionic rectifiers 7, 8, and the output current of the alternating-polarity voltage modulators 18, 19 the thermionic rectifiers 7, 8 operate either in a switching mode featuring a low voltage drop (below 1 kV) across the anode 11, or in a resistive mode, wherein a voltage drop across the anode 11 rises to a value equal to the breakdown voltage on the corona-displaying electrode 16 of the electrical precipitator 17.

In an embodiment of the device, wherein the anode 11 of the thermionic rectifier 7, 8 is shaped as a Faraday cup featuring a developed surface and provided with an intense liquid cooling within time intervals $\tau_i$, $\tau_o$ (FIG. 5) of the rectifier commutation, the edges of the positive and negative polarity pulses are shaped due to conversion of the kinetic energy of the electron beam of the thermionic rectifier 7, 8 (FIG. 1) into heat energy.

The charging cycle of the self-capacity of the electrical precipitator 17 (FIG. 2) starts at a time instant t=0 (FIG. 5) upon enabling the thermionic rectifier 7. The leading edge steepness $\tau_i$ (FIG. 5) depends on the values of R, L, C of the charging circuit, i.e., self-capacity of the electrical precipitator 17 and inductance 13, 15, as well as on the rate of beam deceleration in the thermionic rectifier 7, 8 (FIG. 1).

Time intervals $\tau_i$, $\tau_o$ (FIG. 5) of the wavefronts characteristic of ability to control and modulate power in the electrical precipitator 17 (FIG. 1), depend on the intensity of the load current, voltage on the control electrode 10 of the thermionic rectifier 7, 8, stray capacitance of the latter, and time-lag characteristics of the power circuit, i.e., self-capacity of the electrical precipitator 17 and the inductive elements 13, 15 in the circuit of the rectifying transformer 4 of the constant voltage source 1. Adjusting and stabilizing functions of the thermionic rectifiers 7, 8 are determined from the graphic representation (FIG. 6) of the current of the anode 11 and of the control electrode 10 versus the voltage on the thermionic rectifier 7, 8. The voltage of the control electrode 10 $U_y \sim$ const, and $U_y^1 > U_y^2 > U_y^3$. The nature of these graphic representations renders it possible to effect control over the time interval $\tau_i$ (FIG. 5) of the wavefronts of the alternating-polarity voltage pulses and current limiting of the electrical precipitator 17 (FIG. 1) at the instants when spark or arc discharges are developed in the electrical precipitator 17 in response to signals received from the current pickups 49, 50 of the constant-voltage sources, from the corona-displaying electrode voltage pickup 51, and from the back corona discharge pickup 52. Thus, there is effected flexible and adaptive control of the operation of the electrical precipitator 17, which is accompanied by transient processes, a feature that is of special importance when cleaning gases containing high-resistance dust particles having electric resistivity exceeding $2\times10^8$ Ohm·m.

There arise spark discharges in the course of operation of the gas cleaning electrical precipitator 17, the number of which depends on the parameters of the dust-and-gas flow and geometrical shape of the discharge gap and ranges within 50 and 150 per minute and is liable to increase in ratio with the resistivity of the dust particles.

Figure 6:
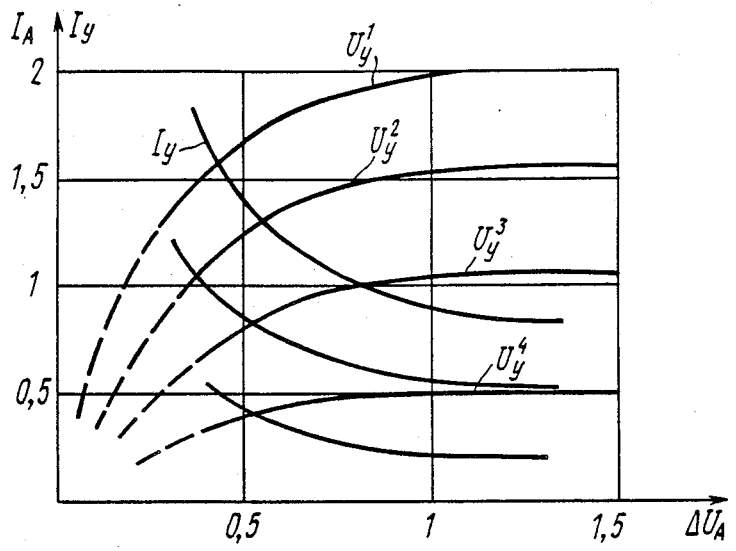
FIG. 6 illustrates graphic representation of the currents on the anode and control electrode vs the voltage on the anode of the thermionic rectifiers, according to the invention.
Figure 5:
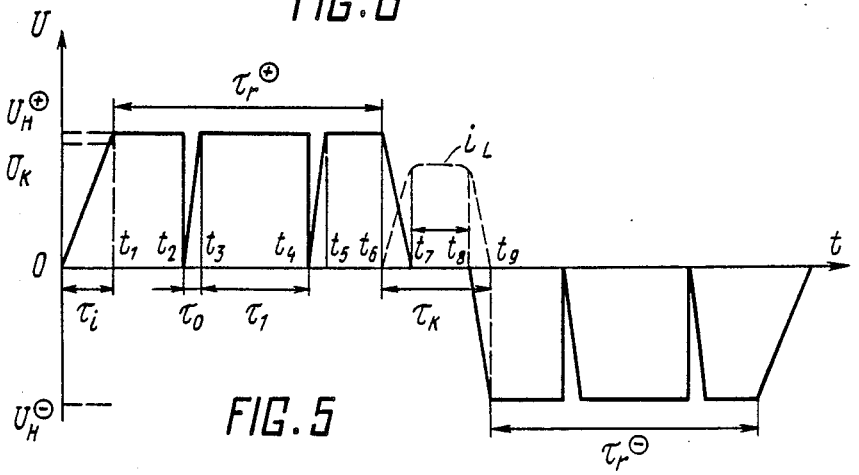
FIG. 5 is a graphic representation of the voltage on the corona-displaying electrode of the electrical precipitator and of the current in the inductive element vs time as referred to the device of FIG. 1, according to the invention.

Spark discharges occur in the electrical precipitator 17 at the time instants $t_2$ and $t_4$ (FIG. 5). The voltage restoration process occurring in the electrical precipitator 17 is accounted for by the properties of the thermionic rectifier 7, 8 and its volt-ampere characteristic (FIG. 6). The thermionic recrifiers 7, 8 (FIG. 1) limit the spark and arc discharge current of the electrical precipitator 17, so that the current magnitude increases as little as 1.5 times. Thus rapid strength restoration of the interelectrode gap in the electrical precipitator 17 occurs within the time interval $\tau_o$ (FIG. 5).

The screening casing 44 (FIG. 1) of the alternating-polarity voltage modulator 18, 19 isolates the control circuits in cases of fast fluctuations of the operating conditions.

Practically no transition of an electric discharge to the arc discharge stage occurs in the electrical precipitator 17, while the spark discharge stage proceeds in such a manner that erosion of the corona-displaying electrode 16 and the precipitating electrode 53 of the electrical precipitator 17, as well as interruption in its power supply are minimized.

The time interval $\tau_r$ (FIG. 5) corresponding to the plateau of the curve is adjusted by properly selecting the time instant when the thermionic rectifier 7 or 8 (FIG. 1) is thrown out of conductance. Once the preset time interval $\tau_r$ (FIG. 5) representing the plateau of the positive-polarity pulse has been followed up, the control unit 40 (FIG. 1) delivers a signal at the time instant $\tau_6$ for the thermionic rectifier 7 to disable and the thermionic rectifier 8 to enable. As a result, the following circuit is established: the rectifier 7, the inductive element 13, the rectifying transformer 4 of the constant voltage source 1, the grounded pole 5 of the source 1, wherein to the self-capacity of the electrical precipitator 17 is discharged. The discharge current flowing through the inductive element 13 is limited and stabilized by the effect of the thermionic rectifier 7 (FIG. 6) with a preset voltage $U_y$ on its control electrode 10.

Current variation $i_L = f(t)$ (FIG. 5) in the inductive element 13 is determined by nonlinear properties of the discharge circuit, wherein there occurs regeneration of the electromagnetic energy accumulated in the self-capacity of the electrical precipitator at a positive polarity of the working voltage.

The energy accumulated in the magnetic field of the inductive element 13 (FIG. 1), is delivered, at the time instant $t_8$, for recharging the self-capacity of the interelectrode gap of the electrical precipitator 17. It is by the time instant $t_9$ (FIG. 5) that the self-capacity of the electrical precipitator 17 (FIG. 1) is completely recharged.

Next the thermionic rectifier 8 shapes the negative half-wave (FIG. 5) of the working voltage. Thus, the thermionic rectifiers 7, 8 controlled completely by means of the alternating-polarity voltage modulators 18, 19 (FIG. 1) provide for regeneration of the electromagnetic energy at the operating voltage polarity reversal in the electrical precipitator 17, as well as energy regeneration of fast transient electrophysical processes proceeding during spark discharges in the electrical precipitator 17.

Width and amplitude of the positive- and negative-polarity pulses are independently adjustable by the control unit 40 to whose inputs signals are supplied from the current pickups 49, 50 of the constant voltage sources, the corona-displaying electrode voltage pickup 51, and the back corona discharge pickup 52.

As a result, the effect of the back corona discharge is reduced or eliminated altogether, while properly selected steepness of the wavefront of current pulses in the electrical precipitator 17 provides for self-shaking of the precipitating electrodes 53 thereof from dust, which is due to an electromechanical effect resulting from an abrupt change of the self-capacity voltage.

Figure 7:
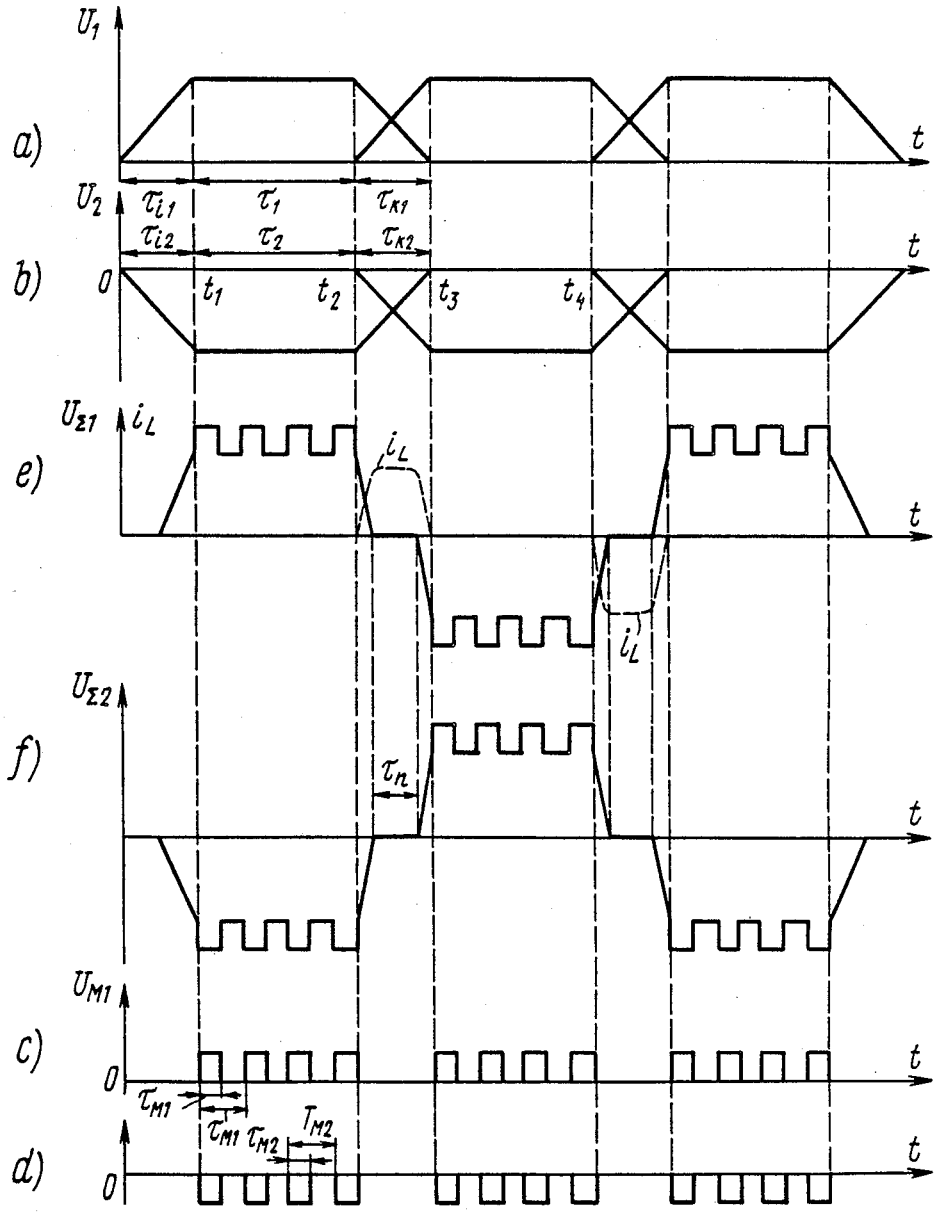
FIGS. 7*a, b* illustrates graphic representation of the voltage on the cathodes and anodes of the thermionic rectifiers connected to the poles of high-voltage sources, vs time as referenced to the device of FIG. 2, according to the invention.
FIGS. 7*c, d* illustrates graphic representation of the voltage at the output of the additional modulators of alternating-polarity voltage vs time, according to the invention.
FIG. 7*e, f* illustrates graphic representation of the voltage on the corona-displaying electrodes of the electrical precipitators vs time, according to the invention.

With the electrical precipitator 17 (FIG. 2) of a multisection design having the sections 62, 63, 64, the rectifiers 7 and 8 of the arms 73, 75 and 74, 76 of the commutation bridge start getting conductive pairwise simultaneously. In response to the signals sent by the current pickups 49, 50 of the constant-voltage source, the corona-displaying electrode voltage pickup 51, and the back corona discharge pickup 52, the control unit 40 registers the time interval $\tau_1$ and $\tau_2$ (FIG. 7*a, b*) representing the plateau of the alternating-polarity voltage pulse. The shaping of the wavefronts of the alternating polarity voltage pulses is completed at the time instant $t_1$, while at the time instant $t_2$ signals are arrived from the lead-outs 60, 61 (FIG. 2) of the control unit 40. As a result, the rectifiers 7, 8 of the respective arms 73, 74 are disabled and the rectifiers 7, 8 of the respective arms 75, 76 are enabled. The time interval $\tau_{k1}$ and $\tau_{k2}$ (FIG. 7*a, b*) is the commutation one when there occur linear reduction of the current in the thermionic rectifier 7 (FIG. 2) of the arm 73 and increase of the current of the thermionic rectifier 7 of the arm 75. An average current picked off within the time intervals $\tau_{k1}$, $\tau_{k2}$, (FIG. 7*a, b*) from the pole 12 (FIG. 1) of the high constant-voltage source 1 features a constant value. It is at the time instant $t_3$ (FIG. 7) that there is completed the commutation interval of the respective pair of the rectifiers 7, 8 (FIG. 2) and the plateau of the voltage pulse is shaped till the time instant $t_4$ (FIG. 7) when commences a next cycle of current changeover between the thermionic rectifiers 7, 8 of the same polarity.

It is in the additional modulators 69 (FIG. 3) comprising, in a particular case, the shaping lines 87 built around LC-circuits, that the capacitors of the shaping lines 87 are charged with the aid of the charging source 83. Once the commutating thyristor 86 has operated in response to a signal delivered to the input 72 of the additional modulator 69 from the control unit 40, the shaping line 87 is discharged. The discharge current flow along the primary 67 of the pulse transformer 65. Output-voltage pulses of a preset width are shaped by the secondary 70 of the pulse transformer 65, 66. The pulsed voltage level is adjusted by the thyristor controller 81, whose control output 71 is connected to the control unit 40. Pulse repetition frequency is varied depending on the instant of triggering the commutating thyristor 86. The pulse transformer 65 performs isolating functions an its insulation is designed to withstand a full operating voltage of the electrical precipitator 17. Each polarity of the output voltage of the device makes use of its own additional modulator 69 which shapes a train of the positive- or negative-polarity pulses (FIG. 7*c, d*) having the following parameters: width $\tau_{M1}$, $\tau_{M2}$; period $T_{M1}$, $T_{M2}$; amplitude $U_{M1}$, $U_{M2}$.

The windings of the pulse transformers 65 having relatively low inductance and designed to shape short-width pulses of the order of tenths of microseconds, act as limiting reactors additionally limiting the pulsed overcurrents resulting from the discharge of the self-capacity of the electrical precipitator 17.

Series-connection of the additional pulse transformers 65, 66 to all arms of the commutating bridge and use of the independent modulators 18, 19 makes possible an individual control of the charging and rate of drift of the charged particles in each of the sections of the electrical precipitator.

The arms 73,74, 75, 76, 77, 78 of the commutating bridge shape an intricately shaped alternating-polarity voltage $U_{\Sigma 1}$, $U_{93\ 2}$ (FIG. 7*e, f*), whose parameters are dependent upon the operation of the modulators 69, the constant voltage sources 1, 2, and the thermionic rectifiers 7, 8. The process of regeneration of the energy accumulated in the self-capacity of each of the sections 62, 63, 64 of the electrical precipitator 17, is accompanied by transfer of the excess energy of the self-capacity of the electrical precipitator 17 into leakage inductance of the pulse transformers 65, 66, which corresponds to the time interval $t_2$–$t_3$, when the inductance current flowing through the transformers 65, 66 is shaped as the current pulse $i_L$. In this case a currentless pause is shaped (the time interval $\tau_n$) in the thermionic rectifiers 7, 8, which renders the commutating operation in the poser supply device more facile.

Superimposition of short-width modulating pulses having the amplitude of $U_{M1}$ and $U_{M2}$ upon the lengthy alternating-polarity voltage pulses with the aid of the modulators 69 (FIG. 2) and the isolation pulse transformers 65, 66 adds to the efficiency of the gas-cleaning process due to separate intensification and control over the charging rate of the dust particles and of the rate of their precipitation on the electrode 53.

Figure 2:
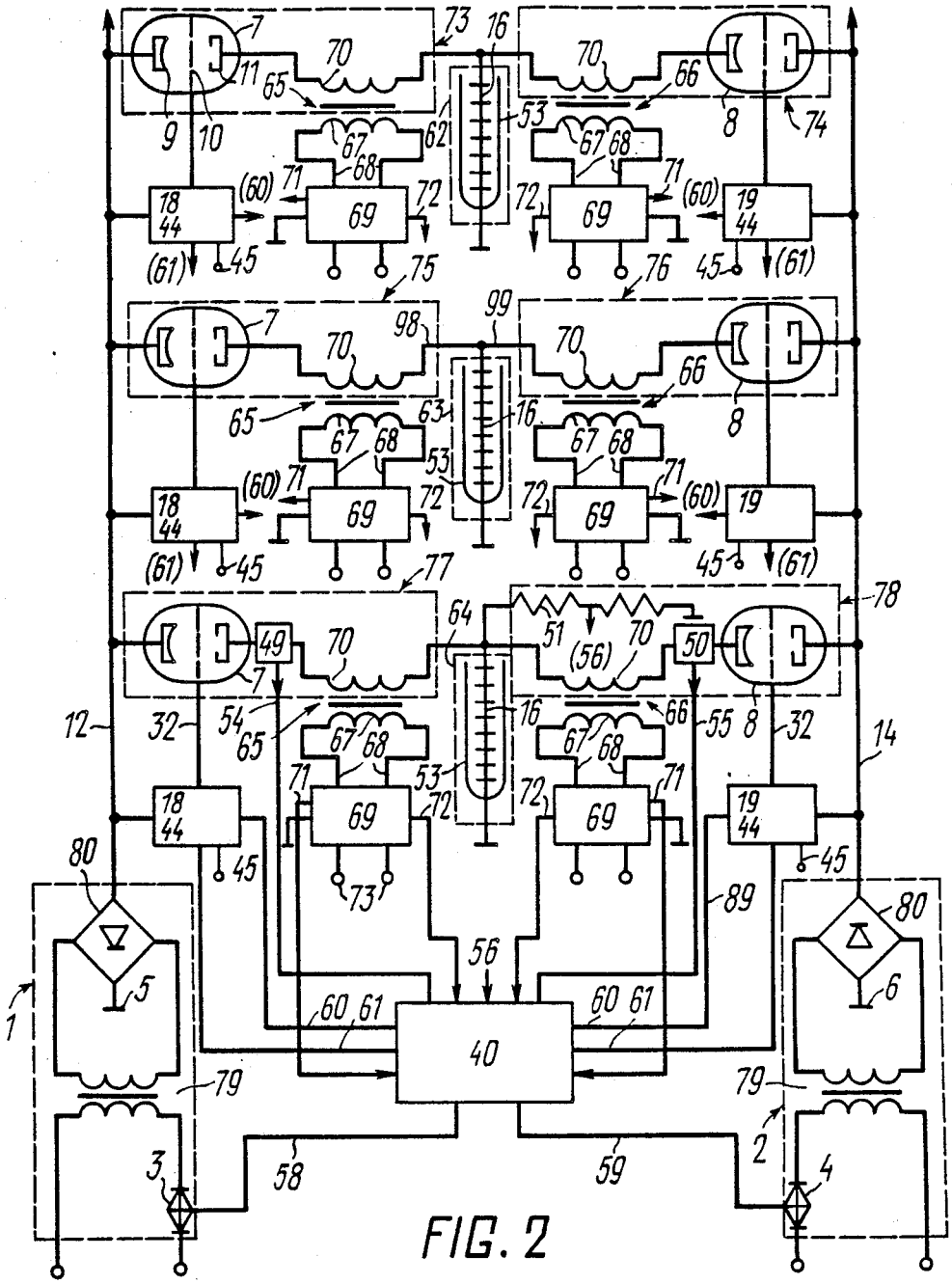
FIG. 2 is a diagram of a device for power supply of multisection gas-cleaning electrical precipitators, according to the invention.
Figure 3:
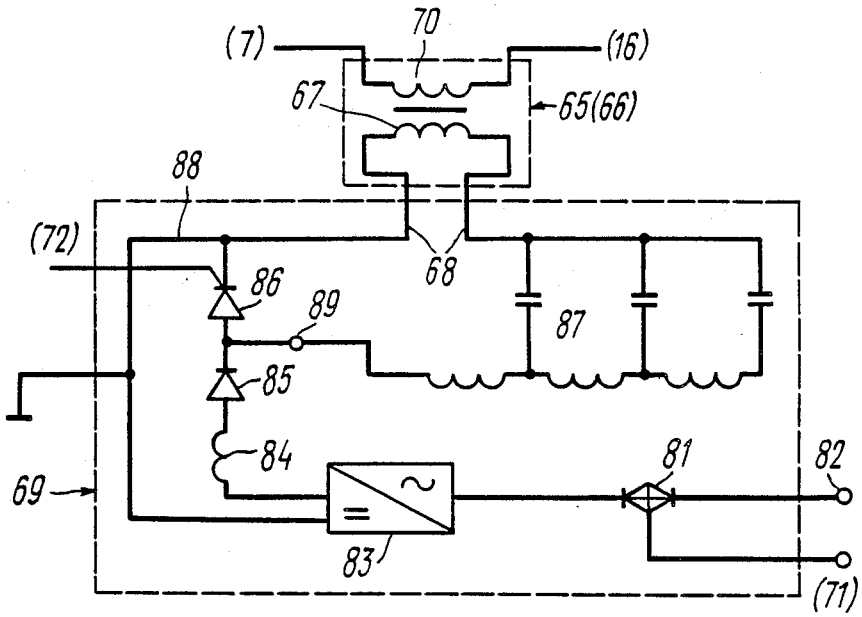
FIG. 3 is an electric circuit diagram of an additional modulator, according to the invention.

Delivery of the resultant alternating-polarity voltage $U_{\Sigma 1}$, $U_{\Sigma 2}$ (FIG. 7*e, f*) having an intricate stepped shape, makes it possible, by changing the parameters of the superimposed pulses having the amplitude of $U_M$, to increase the charge acquired by the dust particles in the field of the corona discharge and the rate of drift of the dust particles towards the precipitating electrode 53 (FIG. 2). Insertion of a relatively low power $P_m$ into the modulation of the main alternating-polarity voltage adds to the efficiency of the gas-cleaning process, the electromagnetic energy regeneration conditions in the time intervals $\tau_{k1}$, $\tau_{k2}$ (FIG. 7) of the rectifier commutation remaining unaffected.

It is due to formation of an intricately shaped alternating-polarity voltage eliminating back corona discharge and the effect of self-shaking of electrodes that continuous current pick off from the unlike-polarity sources 1, 2 of high constant voltage is carried out, which sources may be built around a three-phase bridge circuit. This makes it possible to attain the factor of utilization of the installed power of the sources 1, 2 approximating unity.

When the number of pairs of the thermionic rectifiers 7, 8 is odd, which is the case in FIG. 2, the rectifiers 7, 8 of the arms 77, 78 starts operating at a time delay at the time instant $t_2$.

Further operation of the arms 77, 78 is similar to that of the thermionic rectifiers 7, 8 of the arms 73, 74 of the commutation bridge.

Operation of another embodiment of the device for power supply of a gas-cleaning electrical precipitator is similar to that described above. In this case the additional modulators 69 connected with their outputs 68 parallel to the primaries 67 of the pulse transformers 65, 66, form like-polarity pulses delivered to the arms 92, 94 or 93, 95 of the commutation bridge. The modulators 18, 19 and the isolation transformers 44 are integrated for control of the rectifiers 7 (positive-polarity) or the rectifiers 8 (negative polarity) of all the arms 92, 93, 94, 95. The damping RC-circuits 96, 97 connected to the poles 12 and 14 of the constant voltage sources 1, afford additional protection against overvoltages that are liable to occur in the commutation intervals.

Figure 8:
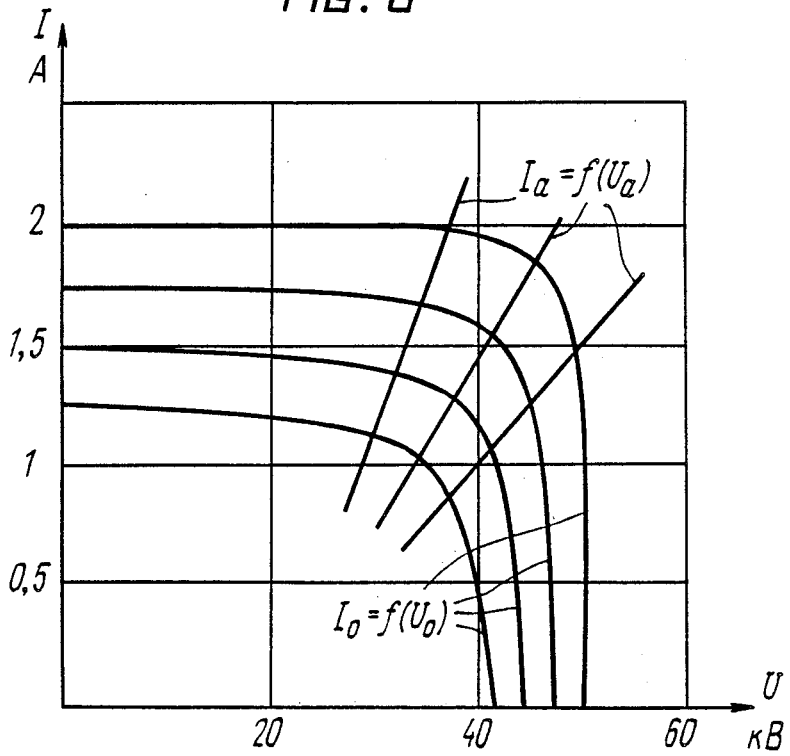
FIG. 8 illustrates graphic representation of electric current of the power supply device and of the electrical precipitator vs voltage, according to the invention.

The external characteristics of the device for power supply of a gas-cleaning electrical precipitator as represented in FIG. 8, are taken separately on the anode of the rectifier 7, or on the cathode of the rectifier 8, or else on the electric cables 98, 99 (FIG. 2). The positive-polarity characteristics of the arms 74, 76, 78 of the commutation bridge are represented in FIG. 2, $I=f(u)$ being adopted in the graphic representation.

Symbols adopted:

$U_o$—output voltage of the cable 99;

$I_o$—output current of one arm of the device;

$I_a$—current consumbed by the electrical precipitator;

$U_a$—voltage on the corona-displaying electrode of the electrical precipitator.

The graphs $I_o=f(U_o)$ are plotted for different nominal power values (within the range of $1A<I_o\leqq 2A$). The graphs $I_a=f(U_a)$ are characteristic of the various values of the dust-and-gas flow parameters (i.e., velocity, moisture content, dust particles concentration). The device for power supply features useful properties of a voltage source (under rated conditions) and of a current source (under transient conditions).

Use of thermionic rectifiers in the present device provides for electromagnetic compatibility of its principal components with one another and with the control units, which adds to the operational reliability of the device. Possibility of bringing the device from operation as a voltage source into operation as a current source in the pulse intervals makes it possible to dispense with the use of a powerful current-limiting reactor, the application of which results in a bad reduction of the installed power utilization factor. When cleaning gases containing high-resistance dust particles, an optimum range of change of the carrier frequency of an alternating-polarity voltage equals 0.01 to 10 Hz, modulation pulse width, 10 to 100 μs, and ratio of voltage amplitudes $U_{M1}/U_1$, 0.1 to 0.3. The width of the main pulse wavefronts may vary within 5 and 20.0 ms, current intensity, up to 2.5 A, voltage within +50 kV.

The device is applicable for power supply of multisection electrical precipitators (n=2 to 8) having a power of the order of hundredths of kW and over. Unsymmetrical power supply of electric precipitators with different-amplitude and width pulses is readily practicable, which makes it possible to additionally stimulate the gas-cleaning process.

INDUSTRIAL APPLICABILITY

The invention can find application for electrical cleaning of flue gases, in thermal power stations, in metallurgy and in the cement industry.

What we claim is:

1. A device for power supply of gas-cleaning electrical precipitators comprising two constant voltage sources (1,2), the unlike poles (5,6) of each of the sources being grounded, two high-voltage commutators connected between the other unlike poles (5,6) of each of the constant voltage sources (1,2) and a corona-displaying electrode (16) of an electrical precipitator (17), and a control unit (40), connected through its inputs to pickups (49, 50, 51, 52) of electrical and physical parameters, and through its outputs to the high-voltage commutators, characterized in that the high-voltage commutators are made as triode-type thermionic rectifiers (7,8) with a hollow anode (11), the device also comprising modulators (18, 19) of alternating polarity voltage equal in number to the number of the thermionic rectifiers (7,8), an input (36, 37) of each of said rectifiers being connected through an isolation transformer (38, 39) thereof to the control unit (40), whereas first and second outputs (35, 26) are connected to a cathode (9) and a control electrode (10) of the thermionic rectifier (7,8) the device further comprising inductive storage elements (13,15) each of which is connected to an electric circuit consisting of a series connected constant voltage source (1,2), the thermionic rectifier (7,8) and the corona-displaying electrode (16) of the electrical precipitator (17).

2. A device as claimed in claim 1, characterized in that the anode (11) of the thermionic rectifiers (7,8) is in fact a Faraday cup.

3. A device as claimed in claim 1 or claim 2 characterized in that the alternating-polarity voltage modulators (18,19) are arranged in a closed conducting screen (31) whose external surface is conductively coupled with the control electrode (10) of the thermionic rectifier (7,8) while the first output (35) of the alternating-polarity voltage modulator (18,19) is insulated from the screen (31), and the second output (26) is connected to the internal surface of the conducting screen (31).

4. A device for power supply of multisection gas-cleaning electrical precipitators as claimed in claim 1 or claim 2 characterized in that each pair of the thermionic rectifiers (7,8), the number of which is equal to that of sections (62, 63, 64) of the electrical precipitator (17), is connected in parallel between the unlike poles (5,6) of two sources (1,2) of constant voltage, and the inductive storage elements (13,15) are in fact pulse transformers (65, 66) whose primaries (67) are connected to at least two additional modulators (69) which are connected to the control unit (40), while the secondaries (70) of the pulse transformers are series-connected between the thermionic rectifier (7,8) and the corona-displaying electrode (16) of the electrical precipitator (17).

* * * * *